US009540896B2

(12) United States Patent
Norrie et al.

(10) Patent No.: US 9,540,896 B2
(45) Date of Patent: Jan. 10, 2017

(54) FRANGIBLE CORE BARREL

(71) Applicant: National Oilwell Varco, L.P., Houston, TX (US)

(72) Inventors: Alan Grant Norrie, Aberdeenshire (GB); Khoi Trinh, Spring, TX (US); Rahul Patel, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 431 days.

(21) Appl. No.: 14/242,325

(22) Filed: Apr. 1, 2014

(65) Prior Publication Data

US 2015/0275604 A1 Oct. 1, 2015

(51) Int. Cl.
*E21B 25/10* (2006.01)
*E21B 25/00* (2006.01)

(52) U.S. Cl.
CPC ..... *E21B 25/00* (2013.01); *E21B 25/10* (2013.01)

(58) Field of Classification Search
CPC ..... E21B 25/10
USPC ..... 175/249
See application file for complete search history.

(56) References Cited

U.S. PATENT DOCUMENTS

| | | | | |
|---|---|---|---|---|
| 2,032,423 | A | 3/1936 | Larson et al. | |
| 4,605,075 | A | 8/1986 | Radford et al. | |
| 2014/0027182 | A1 | 1/2014 | Wilson | |
| 2015/0233201 | A1* | 8/2015 | Kvinnesland | E21B 25/00 175/57 |

FOREIGN PATENT DOCUMENTS

| | | |
|---|---|---|
| BE | 1014459 | 10/2003 |
| SU | 1106891 | 8/1984 |
| WO | 9428281 | 12/1994 |

OTHER PUBLICATIONS

Machine Translation of BE1014459 printed on Aug. 3, 2016.*
International Search Report and Written Opinion mailed Nov. 3, 2015 for corresponding PCT Application No. PCT/US2015/021457. (11 pgs.).
Zahid et al., "Applications of State of the Art Anti-Jam Coring System—A Case Study," Society of Petroleum Engineers 156208; SPEIPAPG Annual Technical Conference, Islamabad, Pakistan; dated Nov. 22-23, 2011 (7 pgs.).
Search Report and Written Opinion dated Nov. 18, 2013 for corresponding International Application No. PCT/US2013/052024 (46 pgs.).
International Preliminary Report on Patentability dated Feb. 5, 2015 for corresponding International Application No. PCT/US2013/052024 (8 pgs.).

* cited by examiner

*Primary Examiner* — Giovanna C Wright
(74) *Attorney, Agent, or Firm* — Derek V. Forinash; Porter Hedges LLP

(57) ABSTRACT

A coring assembly comprises an outer barrel coupled to a coring bit. An inner barrel is disposed within the outer barrel. An inner sleeve is disposed within the inner barrel and includes at least one frangible region that allows the inner sleeve to break so that coring operations can continue after the occurrence of a core jam.

17 Claims, 3 Drawing Sheets

FRANGIBLE CORE BARREL

CROSS-REFERENCE TO RELATED APPLICATIONS

None.

BACKGROUND

This disclosure relates generally to methods and apparatus for acquiring cores from subterranean formations. More particularly, this disclosure relates to methods and apparatus for mitigating the effects of core jamming by utilizing a frangible core barrel.

Formation coring is a well-known process for obtaining a sample of a subterranean formation for analysis. In coring operations, a specialized drilling assembly is used to obtain a cylindrical sample of material, or "core," from the formation so that the core can be brought to the surface. Once at the surface, the core can be analyzed to reveal formation data such as permeability, porosity, and other formation properties that provide information as to the type of formation being drilled and/or the types of fluids contained within the formation. Coring operations include bottom-hole coring, where a sample is taken from the bottom of the wellbore, and sidewall coring, where a sample is taken from the wall of the wellbore. Coring operations can also be performed using conventional wellbore tubulars, such as drill string, or using wireline conveyed tools.

In bottom-hole coring, as a core is being cut, it is received within an elongated tubular receptacle, known as a barrel. As the core moves into the barrel it can become stuck, or "jammed," in the barrel, and prevent additional core from moving into the barrel. Once a jam occurs, the cut core is subjected to increased compressive loads until the coring operation is stopped. Often, the increased compressive loads can damage the core before the coring operation can be stopped. Thus, in many instances, a core jam can result in an insufficient length of core being obtained and/or damage the core that can compromise the desired analysis. Therefore, in bottom-hole coring operations, when a core jam is detected, the coring operation is halted and the tools are brought back to the surface. This can be especially costly in deep wells where it may take several hours to retrieve the coring tools from the bottom of the well.

Thus, there is a continuing need in the art for methods and apparatus for acquiring cores that overcome these and other limitations of the prior art.

BRIEF SUMMARY OF THE DISCLOSURE

A coring assembly comprises an outer barrel coupled to a coring bit. An inner barrel is disposed within the outer barrel. An inner sleeve is disposed within the inner barrel and includes at least one frangible region that allows the inner barrel to break so that coring operations can continue after the occurrence of a core jam.

In certain embodiments, the at least one frangible region comprises a plurality of holes formed through a wall of the inner sleeve, a plurality of slots through a wall of the inner sleeve that form a plurality of axial tabs therebetween, or a groove formed partially through a wall of the inner sleeve. In certain embodiments, groove is continuous about a circumference of the inner sleeve. In certain embodiments, the at least one frangible region is a plurality of frangible regions. In certain embodiments, a first of the plurality of frangible regions has a different strength than a second of the plurality of frangible regions. In certain embodiments, the strength of the first of the plurality of frangible regions is lower than a strength of the second of the plurality of frangible regions and the second of the plurality of frangible regions is closer to the coring bit than the first of the plurality of frangible regions.

In some embodiments, an inner barrel assembly comprises a tubular body coupled to a shoe. An inner sleeve is disposed within the tubular body and coupled to the shoe. The inner sleeve includes at least one frangible region. In certain embodiments, the at least one frangible region comprises a plurality of holes formed through a wall of the inner sleeve, a plurality of slots through a wall of the inner sleeve that form a plurality of axial tabs therebetween, or a groove formed partially through a wall of the inner sleeve. In certain embodiments, groove is continuous about a circumference of the inner sleeve. In certain embodiments, the at least one frangible region is a plurality of frangible regions. In certain embodiments, a first of the plurality of frangible regions has a different strength than a second of the plurality of frangible regions. In certain embodiments, the strength of the first of the plurality of frangible regions is lower than a strength of the second of the plurality of frangible regions and the second of the plurality of frangible regions is closer to the shoe than the first of the plurality of frangible regions.

In some embodiments, A method for coring comprises disposing a coring assembly in a formation, wherein the coring assembly includes an inner sleeve having at least one frangible region. The coring assembly is operated so that a core sample is partially disposed in the inner sleeve and continued until a core jam occurs. The inner sleeve is broken at one of the at least one frangible regions and the coring assembly is operated so that additional core sample is disposed in the inner sleeve. In certain embodiments, the coring assembly is operated until a second core jam occurs, the inner sleeve is broken at another of one of the at least one frangible regions, and additional core sample is disposed in the inner sleeve. In certain embodiments, the coring assembly is operated until a third core jam occurs, the inner sleeve is broken at another of one of the at least one frangible regions, and additional core sample is disposed in the inner sleeve. Operation of the coring assembly can be continued through additional core jams until completed or until no further frangible regions remain unbroken between the jam and the coring bit.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
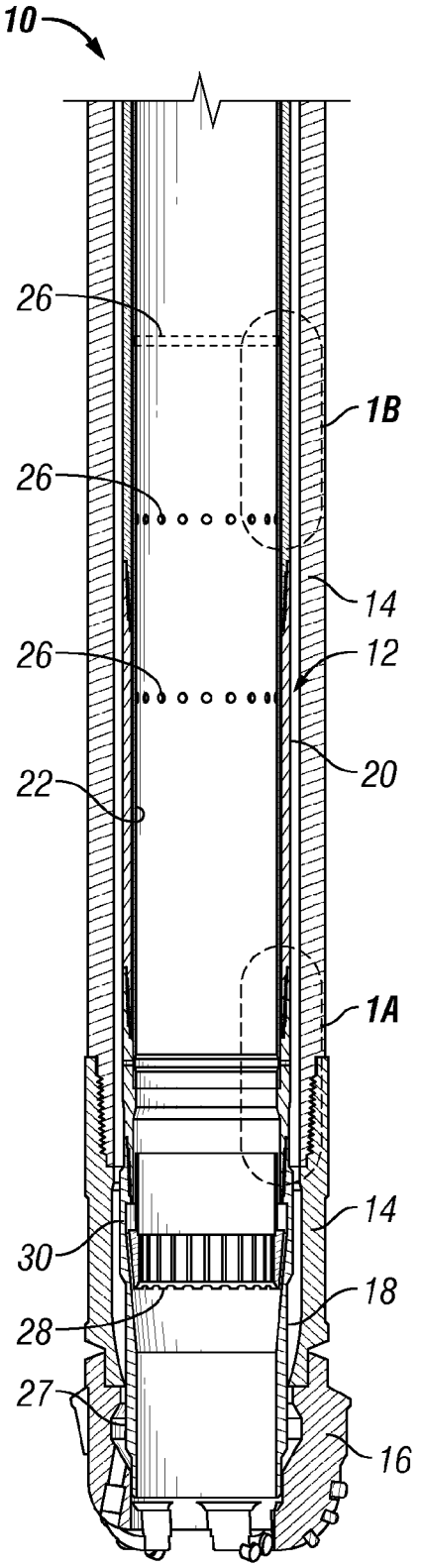
FIG. 1 is a partial sectional view of a coring assembly.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 1A:
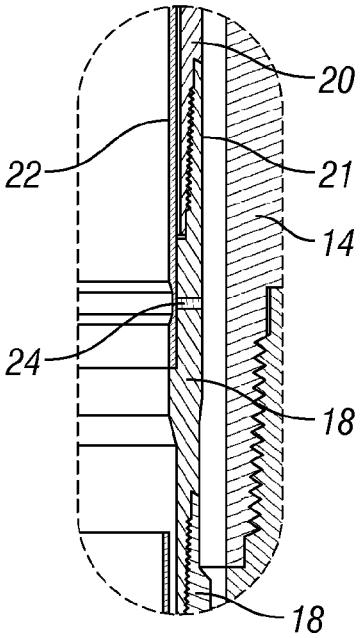
FIG. 1A is a partial sectional view of a portion of the coring assembly of FIG. 1.
Figure 1B:
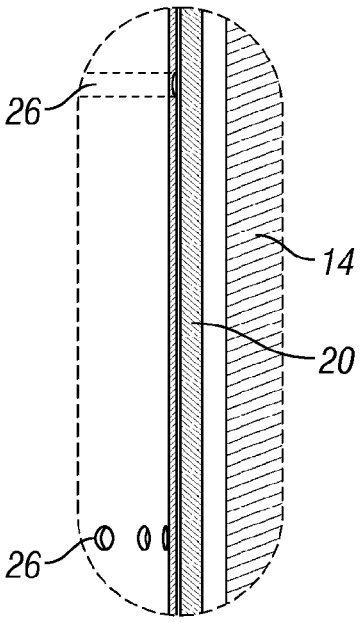
FIG. 1B is a partial sectional view of a portion of the coring assembly of FIG. 1.

Referring initially to FIGS. 1, 1A and 1B, a coring assembly 10 includes an inner barrel assembly 12 that is disposed within an outer barrel 14 and a coring bit 16, which is coupled to the outer barrel 14. In operation, the outer barrel 14 and coring bit are disposed in a wellbore and rotated so that the coring bit 16 cuts a core of material from the formation. As the core of material is cut, it moves through the coring bit 16 and into the inner barrel assembly 12. The inner barrel assembly 12 is not rotationally coupled to the outer barrel 14 or coring bit 16 so that the inner barrel assembly 12 can remain rotationally stationary as the core is being cut.

The inner barrel assembly 12 includes a shoe 18, a tubular body 20, and an inner sleeve 22. The inner sleeve 22 is coupled to the shoe assembly 18 by pin 24, which may be a rivet, shear pin, screw, or other coupling means. The inner sleeve 22 extends from the shoe 18 into the tubular body 20. In certain embodiments, the inner sleeve 22 extends into the lower third of the tubular body 20. In other embodiments, the inner sleeve 22 extends into the lower half of the tubular body 20. The inner sleeve may further include at least one frangible region 26. In embodiments with more than one frangible region 26, the frangible regions 26 are axially spaced along the inner sleeve 22 and may or may not be equally spaced along the inner sleeve 22. The inner sleeve 22 may be manufactured from a metal, plastic, or composite material and may be a continuous sleeve or may be formed from a plurality of sleeve sections connected in series.

The inner sleeve 22 is coupled to the shoe 18 by pin 24. The shoe assembly 18 includes a lower shoe 27 that houses a core catcher 28 and an upper shoe 30 that is coupled to the tubular body 20 by thread 21. As the coring bit 16 and outer barrel 14 are rotated, a core of formation material enters the shoe assembly 18 and passes into the inner sleeve 22. As coring continues, additional core material will continue to longitudinally move through the inner sleeve 22. Once the inner barrel assembly 12 is filled, coring stops and the coring assembly 10, with the core disposed therein, is retrieved to the surface. Coring operations can be performed using conventional wellbore tubulars, such as drill pipe, or using wireline conveyed tools.

In some instances, the core sample may become jammed within the inner sleeve 22 during coring due to a fracture in the core or other reasons. Once the core sample becomes jammed, movement of the core into the inner sleeve 22 is restricted. Continued movement of the coring assembly 10 though the wellbore with the core jammed in the inner sleeve 22 will generate a longitudinal force that will break the inner sleeve 22 at one of the frangible regions 26 located between the core jam and the shoe assembly 18. After the inner sleeve 22 is broken, the portion of the inner sleeve 22 containing the core jam will move longitudinally and coring can continue with additional core moving longitudinally through the portion of the inner sleeve 22 that remains coupled to the shoe assembly 18.

Figure 2:
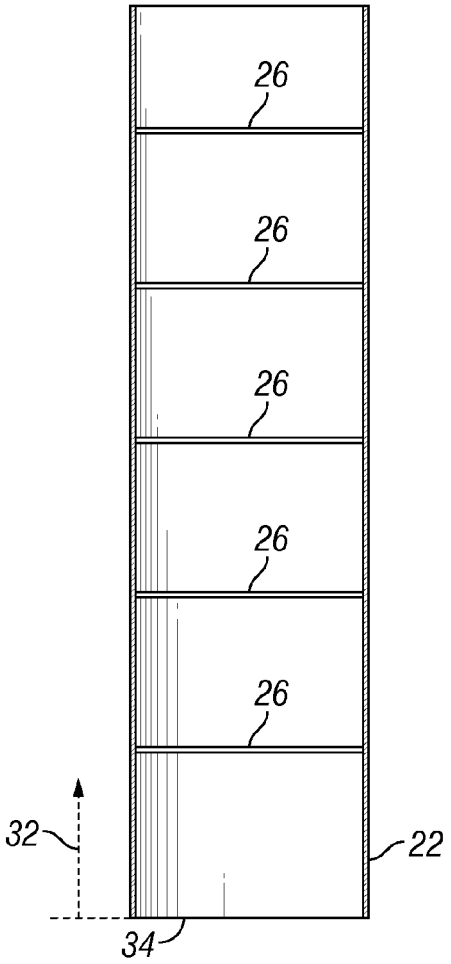
FIG. 2 is a frangible inner sleeve.

Referring now to FIG. 2, an inner sleeve 22 may include a plurality of frangible regions 26 so that multiple core jams can be handled during the coring process. In certain embodiments, the frangible regions 26 are configured so as to break at different tensile loads. For example, inner sleeve 22 may be constructed so that the strength of, or the amount of tensile load required to break, each frangible region 26 decreases as the distance 32 from the frangible region 26 to the lower end 34 increases. In other embodiments, the inner sleeve 22 may have two or more frangible regions 26 that are configured to break at the same tensile load. The frangible regions 26 may be arranged in groups, where each frangible region of a selected group is configured to break at the same tensile load but different groups of frangible regions, or individual frangible regions, are configured to break at different tensile loads. In general, the closer a frangible region 26, or group of frangible regions, is to the lower end 34 of the inner sleeve, the higher the tensile force required to break the frangible region 26. By increasing the strength of the frangible regions 26 as the distance to the lower end 34 of the inner sleeve 22 decreases, the inner sleeve 22 will break at the frangible region 26 between the lower end 34 and the core jam that will maintain a maximum length of inner sleeve 22 still coupled to the shoe assembly 18. Maximizing the length of the inner sleeve 22 still coupled to the shoe assembly 18 provides a maximum number of unbroken frangible regions 26 that can be utilized to handle subsequent core jams.

Frangible regions 26 may take any form and include any features that reduce the tensile strength of the inner sleeve 22. For example, frangible regions 26 may include, but are not limited to, features such as holes, slots, notches, penetrations, perforations, areas of reduced wall thickness, and areas of reduced strength material.

Figure 3:
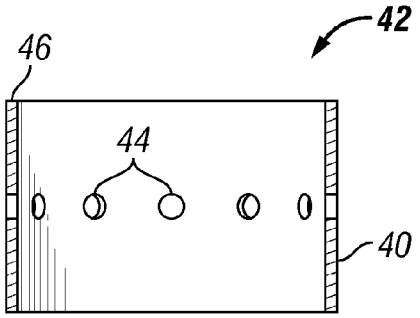
FIG. 3 is a partial sectional view of a frangible inner sleeve having perforations.

By way of example, FIG. 3 illustrates an inner sleeve 40 having a frangible region 42 that includes a plurality of holes, or perforations, 44 through the wall 46 of the inner sleeve 40. The diameter, depth, number, shape, and spacing of the plurality of holes 44 can be varied to determine the strength of the frangible region 42 and the tensile load at which the inner sleeve 40 will break at the frangible region 42.

Figure 4:
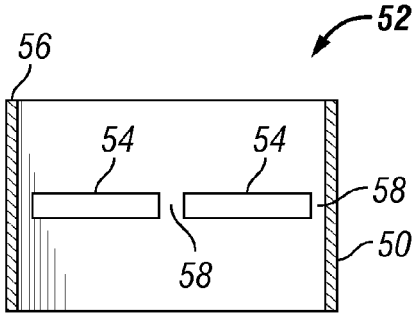
FIG. 4 is a partial sectional view of a frangible inner sleeve having slots.

FIG. 4 illustrates an alternative inner sleeve 50 having a frangible region 52 that includes a plurality of slots 54 through the wall 56 of the inner sleeve 50. The plurality of slots 54 form a plurality of axial tabs 58. The diameter, depth, number, and spacing of the plurality of slots 54 can be varied to determine the placement and configuration of the axial tabs 58, which in turn determines the strength of the frangible region 52 and the tensile load at which the axial tabs 58 will break, allowing the inner sleeve 50 to break at the frangible region 52.

Figure 5:
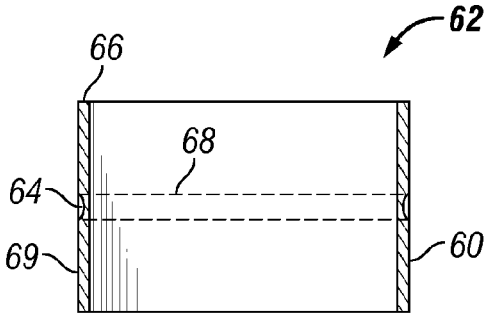
FIG. 5 is a partial sectional view of a frangible inner sleeve having a reduced wall thickness portion.

FIG. 5 illustrates an inner sleeve 60 having a frangible region 62 that includes an area of reduced thickness 64 in the wall 66 of the inner sleeve 60. The area of reduced thickness 64 may be a circumferential groove 68 formed on the outer surface 69 of the inner sleeve 60. The circumferential groove 68 may have a square, circular, or triangular shaped groove and may extend continuously or non-continuously around the circumference of the inner sleeve 60. The depth, quantity, shape, and spacing of the area of reduced wall thickness 64 can be varied to determine the strength of the frangible region 62 and the tensile load at which the inner sleeve 60 will break at the frangible region 62.

The frangible inner sleeves described herein can be used with conventional coring assemblies or may also be used with assemblies utilizing telescoping core barrels as described in U.S. Patent Application Publication No. 2014/0027182, which is hereby incorporated by reference herein for all purposes.

Referring now to FIGS. 6A-6D a simplified inner barrel assembly 70 is shown including an inner sleeve 80 coupled to a guide shoe assembly 82 by pins 84. The inner barrel 80 includes a first frangible region 86, second frangible region 88, third frangible region 90, and fourth frangible region 92. Although inner barrel 80 is illustrated as having four frangible regions, it is understood that inner barrels can be constructed with any number of frangible regions desired and that the greater the number of frangible regions, the greater the number of core jams that can be mitigated during coring operations. The inner barrel assembly 70 is assembled into a coring assembly (not shown) that can be disposed within a wellbore and rotated to cut a core sample 94 that moves longitudinally into the inner sleeve 80 as the coring assembly operates.

Figure 6A:
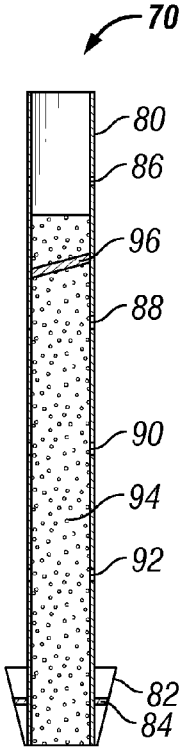
FIGS. 6A-6D is a sequence drawing illustrating the operation of a coring assembly.

As the core sample 94 moves into the inner sleeve 80 as shown in FIG. 6A, the core sample 94 becomes jammed within the inner sleeve 80 at a first core jam 96. The first core jam 96 prevents any further longitudinal movement of the core sample 94 relative to the inner sleeve 80. Continued operation of the coring assembly creates a tensile load in the inner sleeve 80 between the first core jam 96 and the pin 84 that connects the inner sleeve 80 to the guide shoe assembly 82. The tensile load applied to the inner sleeve 80 causes the inner sleeve 80 to break at the second frangible region 88, as is shown in FIG. 6B.

Figure 6B:
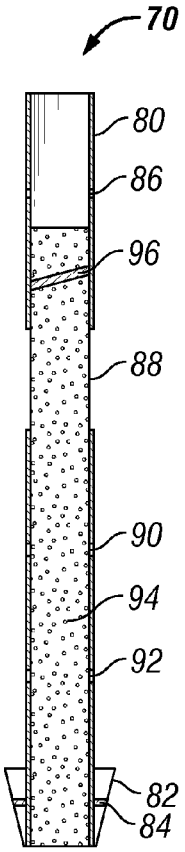
Figure 6C:
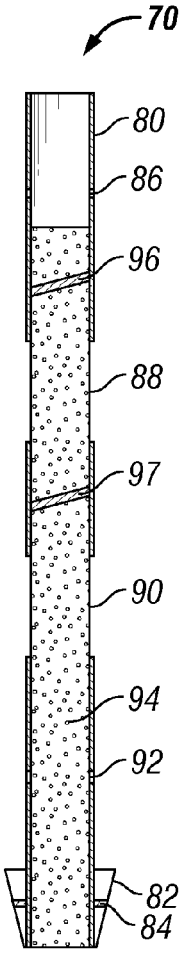
Figure 6D:
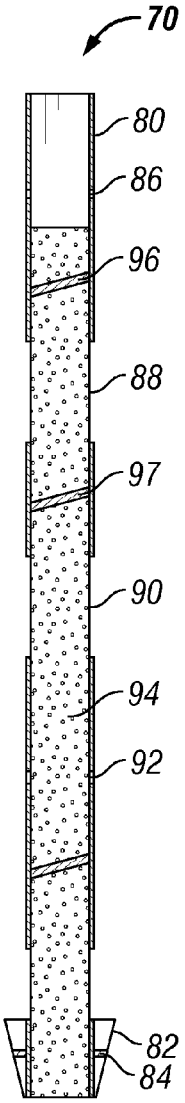

Once the second frangible region 88 breaks, the detached upper portion 98 of the inner sleeve 80 can move away from the guide shoe assembly 82, as shown in FIG. 6B. This movement allows the coring process to continue as additional core sample 94 moves through the inner sleeve 80. If a second core jam 97 occurs within the inner sleeve 80, continued operation of the coring assembly will create a tensile load that will break the inner sleeve 80 at the third frangible region 90, as shown in FIG. 6C. In certain embodiments, the pins 84 may also act as a frangible connection that will allow for coring to be continued through another core jam as shown in FIG. 6D. Once the coring process is complete, or no more frangible regions or connections are available, the coring assembly, including the core is retrieved from the wellbore.

Depending on the progression of the coring process, some or all of the inner barrel assembly 70 and the core sample 94 can be retrieved to the surface. As can be appreciated by those skilled in the art, an inner sleeve 80 constructed with one or more frangible regions provides a system that mitigates the effects of core jams and allows a coring process to continue through one or more core jams.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A coring assembly comprising:
a coring bit;
an outer barrel coupled to the coring bit;
an inner barrel disposed within the outer barrel; and
an inner sleeve disposed within the inner barrel,
wherein the inner sleeve is a single continuous sleeve,
wherein the inner sleeve includes a plurality of frangible regions spaced along the inner sleeve, and
wherein a first of the plurality of frangible regions has a different strength than a second of the plurality of frangible regions.

2. The coring assembly of claim 1, wherein at least one of the plurality of frangible regions comprises a plurality of holes formed through a wall of the inner sleeve.

3. The coring assembly of claim 1, wherein at least one of the plurality of frangible regions comprises a plurality of slots through a wall of the inner sleeve that form a plurality of axial tabs therebetween.

4. The coring assembly of claim 1, wherein at least one of the plurality of frangible regions comprises a groove formed partially through a wall of the inner sleeve.

5. The coring assembly of claim 4, wherein the groove is continuous about a circumference of the inner sleeve.

6. The coring assembly of claim 1, wherein the strength of the first of the plurality of frangible regions is lower than a strength of the second of the plurality of frangible regions and the second of the plurality of frangible regions is closer to the coring bit than the first of the plurality of frangible regions.

7. The coring assembly of claim 6, further comprising:
a shoe assembly, wherein a lower end of the inner sleeve remains coupled to the shoe assembly after breaking the plurality of frangible regions.

8. An inner barrel assembly comprising
a shoe;
a tubular body coupled to the shoe; and
an inner sleeve disposed within the tubular body and coupled to the shoe,
wherein the inner sleeve is a single continuous sleeve, wherein the inner sleeve includes a plurality of frangible regions spaced along the inner sleeve, and wherein a first of the plurality of frangible regions has a different strength than a second of the plurality of frangible regions.

9. The inner barrel assembly of claim 8, wherein at least one of the plurality of frangible regions comprises a plurality of holes formed through a wall of the inner sleeve.

10. The inner barrel assembly of claim 8, wherein at least one of the plurality of frangible regions comprises a plurality of slots through a wall of the inner sleeve that form a plurality of axial tabs therebetween.

11. The inner barrel assembly of claim 8, wherein at least one of the plurality of frangible regions comprises a groove formed partially through a wall of the inner sleeve.

12. The inner barrel assembly of claim 11, wherein the groove is continuous about a circumference of the inner sleeve.

13. The inner barrel assembly of claim 8, wherein the strength of the first of the plurality of frangible regions is lower than a strength of the second of the plurality of frangible regions and the second of the plurality of frangible regions is closer to the shoe than the first of the plurality of frangible regions.

14. The coring assembly of claim 13, wherein a lower end of the inner sleeve remains coupled to the shoe after breaking the plurality of frangible regions.

15. A method for coring comprising:

disposing a coring assembly in a formation, wherein the coring assembly includes a coring bit, a shoe assembly, and an inner sleeve extending from the shoe assembly, the inner sleeve being a single continuous sleeve, the inner sleeve including a plurality of frangible regions spaced along the inner sleeve, wherein a first of the plurality of frangible regions has a different strength than a second of the plurality of frangible regions;

operating the coring assembly so that a core sample is partially disposed in the inner sleeve;

operating the coring assembly until a core jam occurs;

breaking the inner sleeve at the first one of the plurality of frangible regions;

operating the coring assembly so that additional core sample is disposed in the inner sleeve that remains coupled to the shoe assembly after breaking the first one of the plurality of frangible regions;

operating the coring assembly until a second core jam occurs;

breaking the inner sleeve at the second one of the plurality of frangible regions; and operating the coring assembly so that additional core sample is disposed in the inner sleeve that remains coupled to the shoe assembly after breaking the second one of the plurality of frangible regions.

16. The method of claim 15, further comprising:

operating the coring assembly until a third core jam occurs;

breaking the inner sleeve at another one of the plurality of frangible regions;

operating the coring assembly so that additional core sample is disposed in the inner sleeve that remains coupled to the shoe assembly the other one of the plurality of frangible regions.

17. The method of claim 15, further comprising:

operating the coring assembly until coring is complete or until a core jam occurs and there is not a frangible region between the core jam and the coring bit.

* * * * *